US010028540B2

(12) United States Patent
Shearer

(10) Patent No.: US 10,028,540 B2
(45) **Date of Patent: *Jul. 24, 2018**

(54) BRA

(71) Applicant: QP Holdings Limited, New Plymouth (NZ)

(72) Inventor: Richard Heughan Shearer, Taranaki (NZ)

(73) Assignee: QP Holdings Limited, New Plymouth (NZ)

( * ) Notice: Subject to any disclaimer, the term of this patent is extended or adjusted under 35 U.S.C. 154(b) by 90 days.

This patent is subject to a terminal disclaimer.

(21) Appl. No.: 14/981,155

(22) Filed: Dec. 28, 2015

(65) Prior Publication Data

US 2016/0309795 A1 Oct. 27, 2016

Related U.S. Application Data

(63) Continuation of application No. 13/818,979, filed as application No. PCT/NZ2011/000165 on Aug. 23, 2011, now Pat. No. 9,241,514.

(60) Provisional application No. 61/376,894, filed on Aug. 25, 2010.

(51) Int. Cl.
*A41C 3/00* (2006.01)

(52) U.S. Cl.
CPC ..... *A41C 3/0057* (2013.01)

(58) Field of Classification Search
CPC ..... A41C 3/00; A41C 3/0057; A41C 3/0064; A41C 3/10; A41C 3/14; A41C 3/142; A41C 3/144; A41C 3/148
USPC ..... 450/37, 54–57
See application file for complete search history.

(56) References Cited

U.S. PATENT DOCUMENTS

| | | | |
|---|---|---|---|
| 185,362 | A | 12/1876 | Tallman |
| 406,491 | A | 7/1889 | Williams |
| 825,666 | A | 7/1906 | Kull |
| 1,721,739 | A | 7/1929 | Kennedy |

(Continued)

FOREIGN PATENT DOCUMENTS

| | | |
|---|---|---|
| AU | 5391579 | 7/1980 |
| AU | 2010100464 | 6/2010 |

(Continued)

OTHER PUBLICATIONS

"International Search Report for PCT/NZ2011/000165 dated Feb. 10, 2012, 4 pgs.".

*Primary Examiner* — Gloria Hale
(74) *Attorney, Agent, or Firm* — Merchant & Gould P.C.

(57) ABSTRACT

A sport motion control bra having a pair of partial cups which locate, support and shape the lower periphery of the breasts of a user so as to effectively restrict the motion of the breasts relative to the body of a user during sporting activities and one or more side straps which connect to wings extending from each cup so as to, in use, support and locate the sides of the cups.

A sport impact protection and motion control bra including a pair of cups dimensioned to encompass the majority of the breasts of a user. The cups are configured to effectively transfer local impact force through the cup to be dissipated through the bra and surrounding breast tissue and restrict motion of the breasts relative to the body of a user.

The lower edge of each cup may include an inflexion section extending between the torso and breast sections of the bra.

16 Claims, 8 Drawing Sheets

(56) References Cited

U.S. PATENT DOCUMENTS

| | | | |
|---|---|---|---|
| 2,047,230 | A | 7/1936 | Schneider |
| 2,061,268 | A | 11/1936 | Becker |
| 2,191,545 | A | 2/1940 | Montclair |
| 2,222,523 | A | 11/1940 | Williams et al. |
| 2,391,417 | A | 12/1945 | Hill |
| 2,429,680 | A | 10/1947 | Goddard |
| 2,445,767 | A | 7/1948 | Dickerson et al. |
| 2,468,106 | A | 4/1949 | Polk et al. |
| 2,472,940 | A | 6/1949 | Cummings |
| 2,516,129 | A | 7/1950 | Leo et al. |
| 2,579,365 | A | 12/1951 | Condé |
| 2,598,003 | A | 5/1952 | Tinker |
| 2,608,689 | A | 9/1952 | Van Leuven et al. |
| 2,611,898 | A | 9/1952 | Laird |
| 2,659,085 | A | 11/1953 | Ericson |
| 2,686,312 | A | 8/1954 | Schmidt et al. |
| 2,734,193 | A | 2/1956 | Croxall et al. |
| 2,824,563 | A | 2/1958 | Hill |
| 2,915,067 | A | 12/1959 | Bracht et al. |
| 2,949,916 | A | 8/1960 | Paveza |
| 2,992,646 | A | 7/1961 | Weinberg |
| 3,021,845 | A | 2/1962 | Smith et al. |
| 3,077,196 | A | 2/1963 | Paxton |
| 3,162,861 | A | 12/1964 | Gtafson |
| 3,176,686 | A | 4/1965 | Barnes |
| 3,196,460 | A | 7/1965 | Halstead |
| 3,225,768 | A | 12/1965 | Galitzki et al. |
| 3,421,515 | A | 1/1969 | Schaefer |
| 3,478,739 | A | 11/1969 | Librande et al. |
| 3,896,506 | A | 7/1975 | Hankin et al. |
| 3,911,503 | A | 10/1975 | Hankin |
| 4,217,905 | A | 8/1980 | Atwater et al. |
| 4,254,777 | A | 3/1981 | Johnston |
| 4,292,975 | A | 10/1981 | Champion et al. |
| 4,298,008 | A | 11/1981 | Kylberg |
| 4,314,569 | A | 2/1982 | Speno |
| 4,566,458 | A | 1/1986 | Weinberg |
| 4,607,640 | A | 8/1986 | McCker |
| 4,632,118 | A | 12/1986 | Garutso |
| 4,992,074 | A | 2/1991 | Diaz |
| 5,020,157 | A | 6/1991 | Dyer |
| 5,022,887 | A | 6/1991 | Lawson |
| 5,244,432 | A | 9/1993 | Moy Au et al. |
| 5,281,186 | A | 1/1994 | Buckley et al. |
| 5,439,409 | A | 8/1995 | McCracken et al. |
| D364,250 | S | 11/1995 | McCracken et al. |
| 5,730,641 | A | 3/1998 | Brown |
| 5,769,688 | A | 6/1998 | Holliday |
| 5,806,103 | A | 9/1998 | McCracken et al. |
| 5,820,444 | A | 10/1998 | McGaughey |
| 6,083,079 | A | 7/2000 | Pearson |
| 6,083,080 | A | 7/2000 | Lawson et al. |
| 6,110,005 | A | 8/2000 | Stephenson et al. |
| 6,165,045 | A | 12/2000 | Miller et al. |
| 6,346,028 | B1 | 2/2002 | Fildan et al. |
| 6,375,537 | B1 | 4/2002 | Jankowski |
| 6,397,391 | B2 | 6/2002 | DeMarco |
| 6,402,585 | B1 | 6/2002 | Gatto et al. |
| 6,425,800 | B1 | 7/2002 | Huang |
| 6,431,946 | B1 | 8/2002 | Fildan et al. |
| 6,437,365 | B1 | 8/2002 | Hawley et al. |
| 6,439,959 | B1 | 8/2002 | Magrone et al. |
| 6,439,960 | B1 | 8/2002 | Fildan et al. |
| 6,447,365 | B1 | 9/2002 | Powell et al. |
| 6,688,942 | B2 | 2/2004 | Holliday |
| 6,811,463 | B2 | 11/2004 | Martz |
| 6,846,219 | B2 | 1/2005 | Moyer |
| 6,966,815 | B2 | 11/2005 | Weinerth |
| 7,081,035 | B2 | 7/2006 | Kawakami |
| 7,234,994 | B2 | 6/2007 | Fildan et al. |
| 7,238,080 | B2 | 7/2007 | Gimble |
| 7,377,833 | B1 | 5/2008 | Wanzenboeck et al. |
| 7,407,428 | B2 | 8/2008 | Fildan et al. |
| 7,425,170 | B1 | 9/2008 | Herbert et al. |
| 7,442,110 | B2 | 10/2008 | Gaudet et al. |
| 7,591,707 | B2 | 9/2009 | Yu et al. |
| 7,731,564 | B2 | 6/2010 | Sanders |
| 2004/0198177 | A1 | 10/2004 | Jankowski |
| 2005/0075048 | A1 | 4/2005 | Legaspi |
| 2006/0252346 | A1 | 11/2006 | Reinisch |
| 2007/0155283 | A1 | 7/2007 | McQueer |
| 2007/0281584 | A1* | 12/2007 | Liu ..... A41C 3/00 450/1 |
| 2007/0298682 | A1 | 12/2007 | Liu |
| 2008/0027744 | A1 | 1/2008 | Nethero |
| 2008/0090491 | A1 | 4/2008 | Liu |

FOREIGN PATENT DOCUMENTS

| | | |
|---|---|---|
| CA | 2456490 | 7/2005 |
| FR | 674945 | 2/1930 |
| FR | 756732 | 12/1933 |
| FR | 2689377 | 4/1992 |
| FR | 2864429 | 7/2005 |
| GB | 324870 | 2/1930 |
| GB | 413228 | 7/1934 |
| GB | 496777 | 12/1937 |
| GB | 590284 | 7/1947 |
| GB | 2069318 | 8/1981 |
| GB | 2155760 | 10/1985 |
| GB | 2456897 | 8/2009 |
| JP | 8060411 | 3/1996 |
| JP | 11131307 | 5/1999 |
| JP | 2001288604 | 10/2001 |
| NZ | 189273 | 9/1982 |
| WO | WO2009101287 | 8/2009 |

* cited by examiner

BRA

This application is a Continuation of U.S. application Ser. No. 13/818,979, now U.S. Pat. No. 9,241,514, filed 28 Feb. 2013, which is a National Stage Application of PCT/NZ2011/000165, filed 23 Aug. 2011, which claims benefit of US Provisional Application No. 61/376,894, filed 25 Aug. 2010, and all of which applications are incorporated herein by reference. To the extent appropriate, a claim of priority is made to each of the above disclosed applications.

FIELD OF THE INVENTION

This invention relates to a bra. More particularly, although not exclusively, the invention relates to a sport motion control and/or impact protection bra.

BACKGROUND OF THE INVENTION

A wide range of bras have been produced for general use, typically with the aim of providing a basic level of support and to achieve aesthetic outcomes in relation to breast form and the appearance of the bra itself. Such "general use" bras typically provide sub-optimal impact protection and breast motion control.

Static Support and Shaping

With a traditional fabric bra, support is provided by positioning of the breast relative to the body of the wearer and influencing the shape of the breast through the application of a flexible boundary in the form of a flexible fabric cup. Positioning of the breast above its natural position is termed uplift. With a traditional fabric bra uplift is often achieved by tensioning of the shoulder strap of the bra. An alternate mechanism for uplift is to provide inserts in the lower portion of the bra cup that displace the breast.

With a traditional fabric bra uplift is achieved by tensioning the fabric of the cup between its lower edge (often the location of an underwire) and the shoulder strap, to a position where there is no overlap of the breast tissue with the torso of the wearer.

With a traditional fabric bra the resulting shape of the breast is a function of the volume and geometry of the breast, the degree of uplift/material tension and the shape and construction of the flexible fabric cup. As the optimum position of the breast varies between individuals the degree of uplift required and the resulting shape is likely to be different for each wearer of a particular bra. This contributes to significant industry-wide challenges of fit and bra choice.

Motion Control

Control of motion of the breasts during activity is important. Motion of the breasts relative to the body can cause breast pain and longer term can lead to deterioration of the natural support mechanisms for the breasts. These factors can have a negative impact on the participation of women in sports and other activities.

With a traditional fabric bra motion control of the breast during activity is achieved through provision of a flexible boundary in the form of a fabric cup. Typically improved motion control is achieved through compression (where the breast is compressed against the torso) or encapsulation (where the breast is held by an inelastic cup form). Of these mechanisms encapsulation is generally preferred as it does not affect the mobility and ability to breathe of the wearer.

A further element that is typically used to provide location and motion control of the breast is an underwire which forms a rigid narrow boundary around the lower periphery of the fabric cup.

The motion control performance of a traditional fabric bra is limited by the shape and positioning of the breast relative the body of the wearer and the construction of the bra. As a flexible cup cannot maintain geometry of the breast, movement of the breast mass can occur within the cup itself. The motion-control performance of the bra is subject to the same vagaries as outlined for static support.

Impact Protection

The participation of women in activities where there is a probability of physical impact on the breast, such as soccer, is increasing. Physical impact on the breast can cause short-term pain and bruising which may have an impact on participation and confidence.

With a traditional fabric bra the breasts are provided minimal protection against physical impacts and associated pain and bruising often experienced during sporting activity.

In summary traditional fabric bras do not perform at an optimum level for a broad variety of wearers. This can result in breast compression, discomfort, pain, undesirably and unconstrained motion, undue load on the shoulders. Such bras also provide little impact protection and limited motion control (typically only about 50% over all three dimensions compared to a no-bra condition). Underwire bras provide location of the bra around the lower periphery of the breast but do not significantly contribute to breast support, uplift, motion control or shaping.

Some bras have been developed that have removable cups or cup inserts. Bras including removable cups are inconvenient and difficult to integrate into the bra structure and provide sub-optimal performance. Multiple material structures are complex and expensive to construct.

Specific impact protection and/or sports bras can provide good protection and motion control but are typically rigid, bulky, unfashionable, inhibit movement and/or restrict breathing. In sports such as soccer a combination of impact and motion control may be required whereas in other activities one or other may suffice.

U.S. Pat. No. 2,061,268 discloses a moulded full-cup structure which holds a breast in a preferred shape.

GB496777 discloses a chest and part-cup cantilever structure comprising of a laminate of fabric and polymer.

GB590284 discloses a plastic shaped cup reinforcing element.

U.S. Pat. No. 2,429,680 discloses an independent pallet/shelf comprising a single piece part-cup and underband structure.

U.S. Pat. No. 3,225,768 discloses a method of laminating a plastic breast form to fabric to create a 3-d shaped article of clothing.

U.S. Pat. No. 6,431,946 discloses an underwire structure that extends into the cup of the bra.

U.S. Pat. No. 6,439,959 discloses a multiple-piece or single piece plastic form structure for a bra made of soft, flexible foam.

U.S. Pat. No. 6,447,365 discloses a rigid underwire structure that is incorporated into a soft polymer structure that extends into and outside the cup of the bra.

U.S. Pat. No. 6,966,815 discloses a stiffening element that is incorporated into the underband of a bra.

U.S. Pat. No. 7,234,994 discloses a u-shaped hard underwire rolled into a soft plastic body.

GB2456897 discloses a flexible lower bra cup that extends past the conventional underwire and into the underband.

WO2009/101287 discloses a laminated stiffening structure in the form of fingers and peripheral which operates to contain the cup of a bra.

None of the above patents address the issues of effective motion control or impact protection for a sports bra.

The following physical impact bras are also known:

U.S. Pat. No. 4,607,640 discloses a bra having removable elements.

U.S. Pat. No. 5,022,887 discloses a bra having two overlapping cups that are held away from the breasts.

U.S. Pat. No. 6,083,080 discloses a laminated full-cup protective bra with layers of neoprene on the inside and outside of the polyethylene protector.

Whilst providing some impact protection the designs lack either comfort, mobility or effective motion control It would be desirable to provide a bra providing good impact protection and/or motion control that is comfortable, compact, flexible and allows relatively free movement or to at least provide the public with a useful choice.

Exemplary Embodiments

According to one exemplary embodiment there is provided a sport motion control bra including:

a. a pair of partial cups which locate, support and shape the lower periphery of breasts of a user so as to effectively restrict the motion of the breasts relative to the body of a user during sporting activities; and b. one or more side straps which connect to wings extending from each cup so as to, in use, support and locate the sides of the cups.

According to another exemplary embodiment there is provided a sport impact protection and motion control bra including:

a. a pair of cups each having side wings extending from the outer side of each cup and tabs extending from the top of each cup, the cups being dimensioned to encompass the majority of the breasts of a user and to effectively transfer local impact force through the cup to be dissipated through the bra and surrounding breast tissue and restrict motion of the breasts relative to the body of a user;

b. one or more side straps which connect to the wings so as to, in use, anchor the sides of the cups to the torso of a user; and c. shoulder straps connected to the top tabs.

According to a further exemplary embodiment there is provided a sport impact protection bra including:

a. a pair of cups each having side wings extending from the outer side of each cup and tabs extending from the top of each cup, the cups being dimensioned to encompass the majority of the breasts of a user and to effectively transfer local impact force through the cup to be dissipated through the bra and surrounding breast tissue;

b. one or more side straps which connect to the wings so as to, in use, anchor the sides of the cups to the torso of a user; and c. shoulder straps connected to the top tabs.

The lower edge of each cup preferably includes an inflexion section extending between the torso and breast sections of the bra.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention.

DETAILED DESCRIPTION OF EMBODIMENTS OF THE INVENTION

Figure 1:
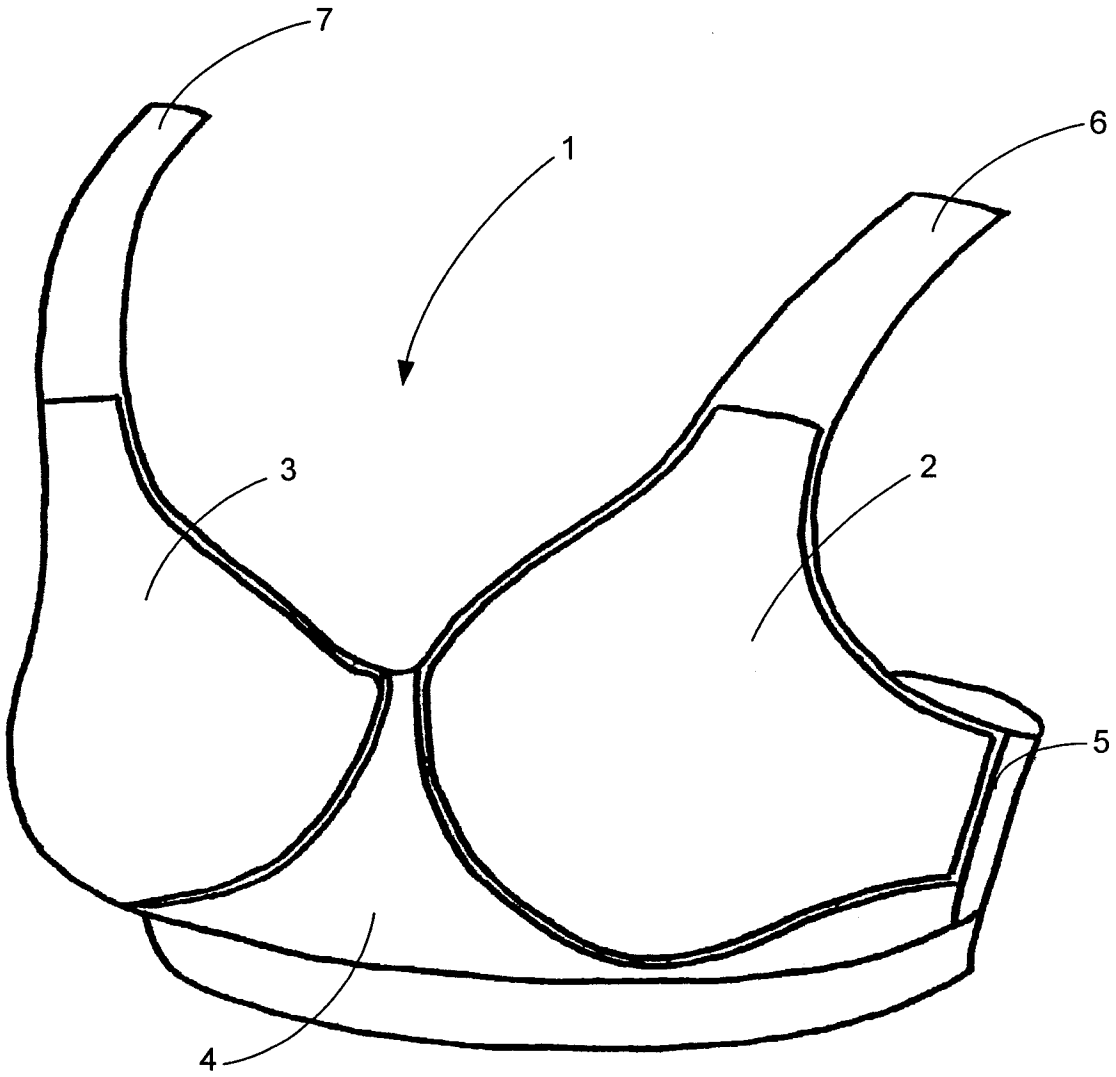
FIG. 1 shows a bra including full cups.
Figure 2:
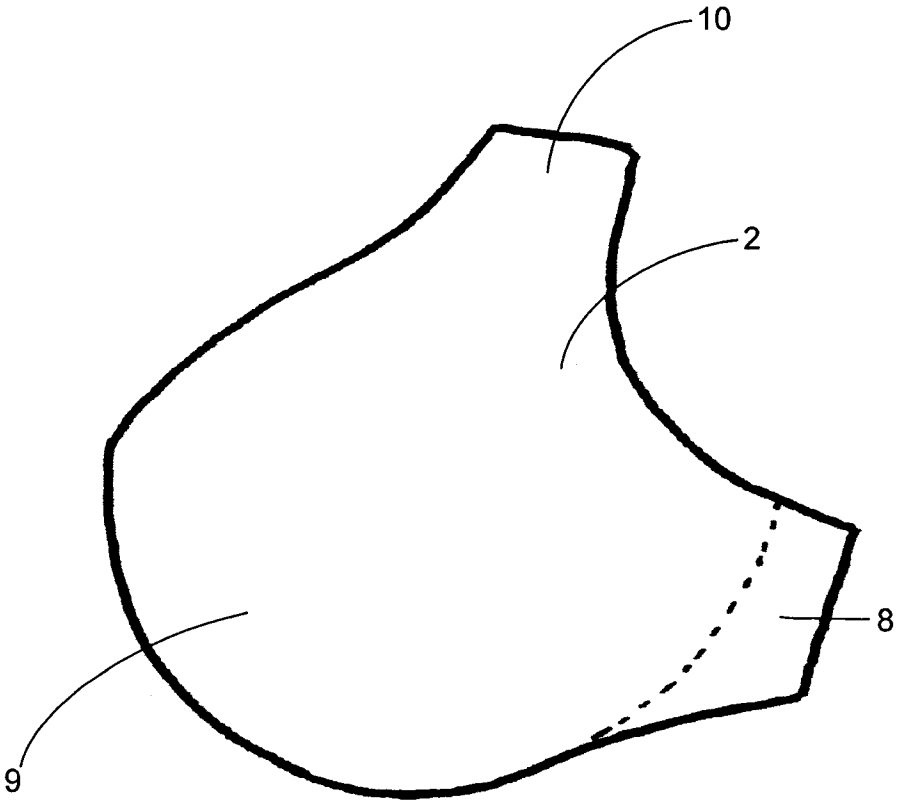
FIG. 2 shows a cup of the bra shown in FIG. 1.
Figure 3:
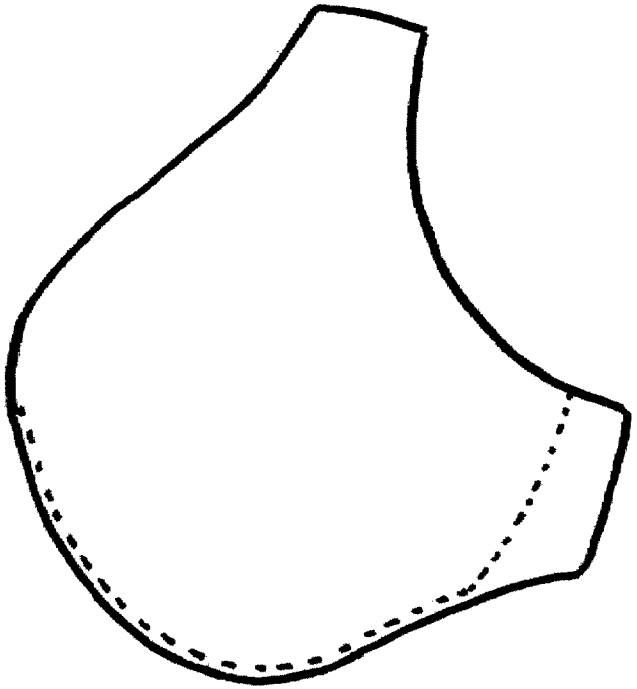
FIG. 3 shows another view of a cup of the bra shown in FIG. 1.
Figure 4:
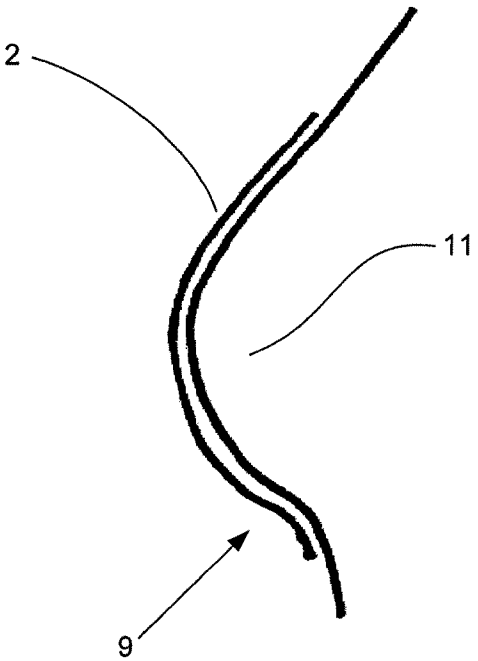
FIG. 4 illustrates the uplift generated by the cup of the bra shown in FIGS. 1 to 3 and location of the breast by providing an area of inflexion.

The present invention is primarily directed to sport motion control and sport impact protection bras. A sport motion control bra is a bra that significantly constrains the motion of breasts as a sum of its three dimensional movement (e.g. motion control as a sum of three dimensional movement reduced in the order of 80% compared to a no-bra condition). A sport impact protection bra is one capable of effectively dissipating local impact forces outside the local impact area (e.g. of the order of 75% of local impact force dissipated outside the local impact area).

Referring to FIGS. 1 to 5 a sport impact and motion control bra according to a first embodiment is shown. Bra 1 includes a pair of full cups 2 and 3 supported by a fabric body 4. Side straps 5 connect at the back and shoulder straps 6 and 7 extend from tabs 10 to connect around the neck or at the back to secure the bra to a user.

Cups 2 and 3 may be formed of a material that has sufficient rigidity to impose a desired shape on the breast of a user and distribute impact force but which is flexible enough to provide freedom of movement. The cups may suitably be formed by injection molding using a material such as low density polyethylene. Alternatively they may be of a composite construction. The cups may decrease in thickness towards all or part of the periphery to provide greater flexibility at the perimeter. Alternatively or additionally "fingers" may be provided about all or part of the periphery in the form of spaced apart finger sections. Foam cushioning, such as shape memory foam, may be provided within the cups. The bra may be formed as an integrated article with the parts glued, stitched or ultrasonically welded together etc.

Figure 5:
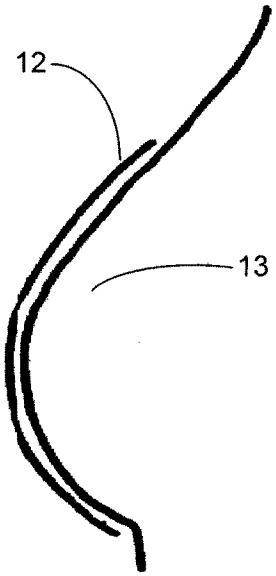
FIG. 5 illustrates the limited location from a cup without an area of inflexion.

Cup 2 (as per cup 3 also) is shown to include a wing 8 which extends to an area under the arm of a user and acts as a cantilever to support cup 2. This provides an effective "armature" as traditionally provided in prior art designs by an underwire etc. The lower edge of cup 2 includes an inflexion region 9 where a reverse curve serves to lift the lower part of the breast 11 and provide an anchor along the adjacent area of the torso of a user to support the cup (as compared to a cup 12 without inflexion about breast 13 as shown in FIG. 5). This inflexion provides shape and location to the breasts and avoids overlap of the breast onto the torso. It also provides a location on the chest wall for cantilever support. In addition, the approximate orthogonal inflexion of the 'wing' provides support for the cup but also provides a cantilever for sideways motion of the breast relative to the body.

The cup shape imposes a shape on the breast that better positions the mass of the breast to reduce motion. In this way an ideal shape may be imposed rather than shape being the result of individual anatomy and the flexible nature of the fabric cup.

The cups 2 and 3 are chiral (left and right handed) to impose an ideal shape on each breast. The configuration transfers the load of 'uplift' to the wing 8 acting as a cantilever (i.e. to the chest band rather than principally to the shoulder straps 6 and 7). The load on the shoulder straps 6 and 7 is between the shoulders and the upper edge of the cups to prevent spillover of the breast over the cups.

In effect the insert is taking the bulk of the static load and limits the sideways and downward motion of the breast during exercise. The shoulder load is related to the tension between the top of the insert and the shoulder strap rather than the underwire and the shoulder strap. Thus stresses on the shoulders should be less to achieve the same degree of static uplift. Sideways motion is also reduced due to the anchoring via wing 8.

Figure 6:
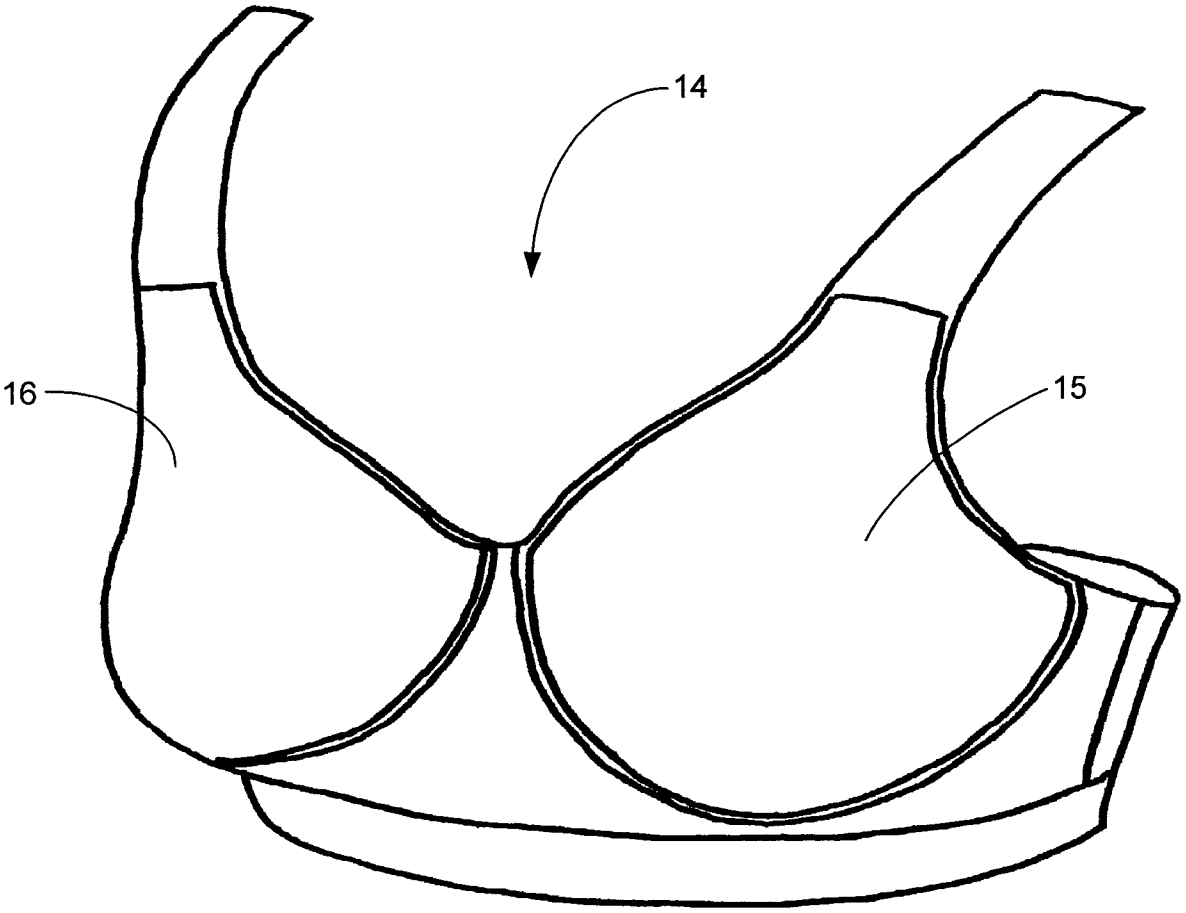
FIG. 6 shows a bra including full cups according to a second embodiment.
Figure 7:
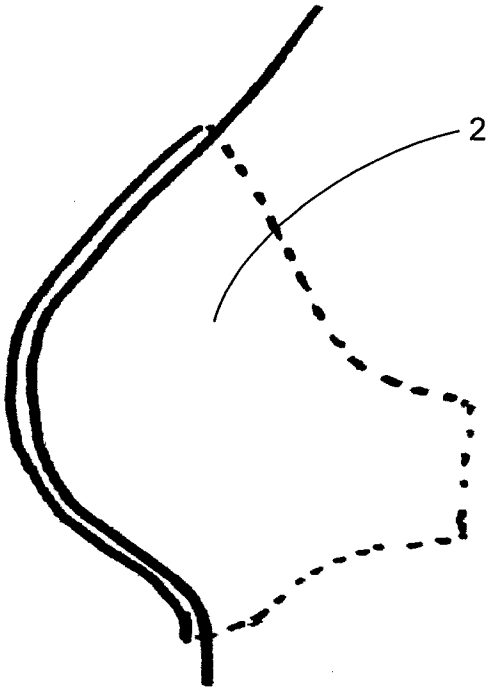
FIG. 7 shows a side view of a cup of the type shown in FIGS. 1 to 3.
Figure 8:
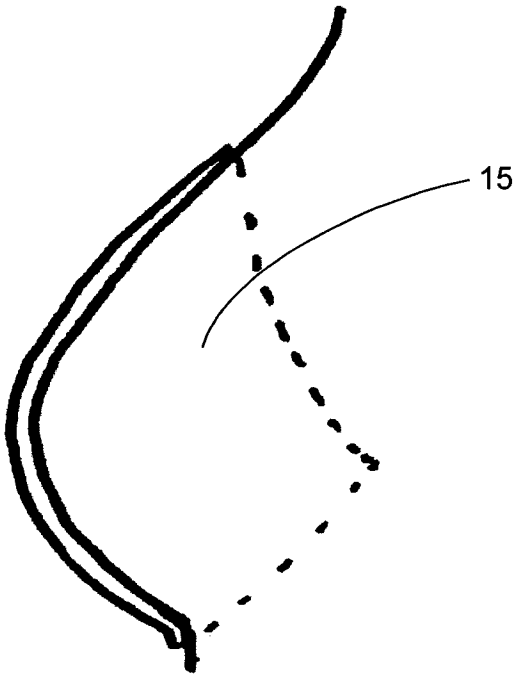
FIG. 8 shows a side view of a cup of the type shown in FIG. 6.

Referring to FIG. 6 an alternative full cup bra embodiment 14 is shown. In this case the cups 15 and 16 do not include the wings 8 of the previous embodiments. The side profiles of the two cup designs are compared in FIGS. 7 and 8.

Figure 9:
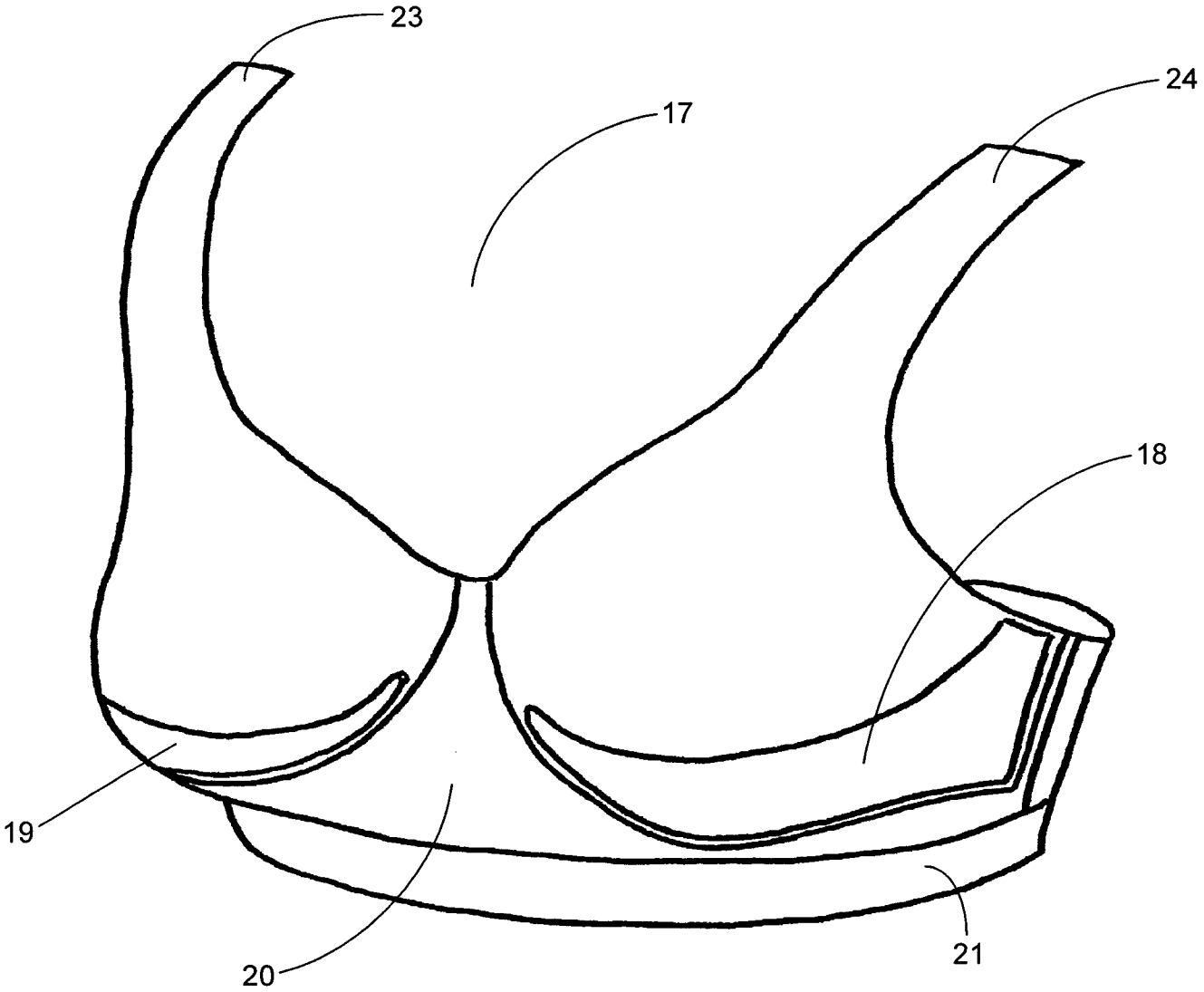
FIG. 9 shows a bra including a partial cup.
Figure 10:
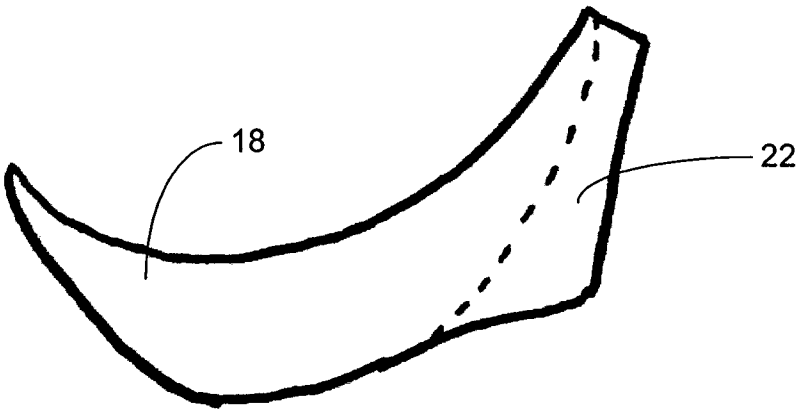
FIG. 10 shows the partial cup of the bra shown in FIG. 9.

Referring now to FIGS. 9 and 10 a partial cup embodiment is shown. Bra 17 has partial cups 18 and 19 supporting the lower periphery of a user's breasts. These partial cups are integrated into the fabric body 20 of the bra 17 as per the previous embodiments. As in the previous embodiments the partial cups have an inflexion region along their lower edges which assists in lifting the breasts and imposing a desired shape on the breasts. The cups are shaped to locate the breasts in an optimized position and support and shape the lower periphery of the breasts of a user so as to effectively locate, shape and restrict the motion of the breasts relative to the body of a user during sporting activities. An underband 21 is provided to anchor the bottom of the bra to the torso of a user. It has been surprisingly found that by providing a partial under breast support to only about 20% of the volume of the breast that the sum of motion of the breasts in all three dimensions can be reduced by about 80% compared to a no-bra situation.

As in the previous embodiments wings 22 act as a cantilever to anchor the partial cups and inhibit motion. Due to this anchoring effect with underband 21 combined with the inflexion region the partial cups can provide support and motion control without placing undue load on straps 23 and 24.

Figure 11:
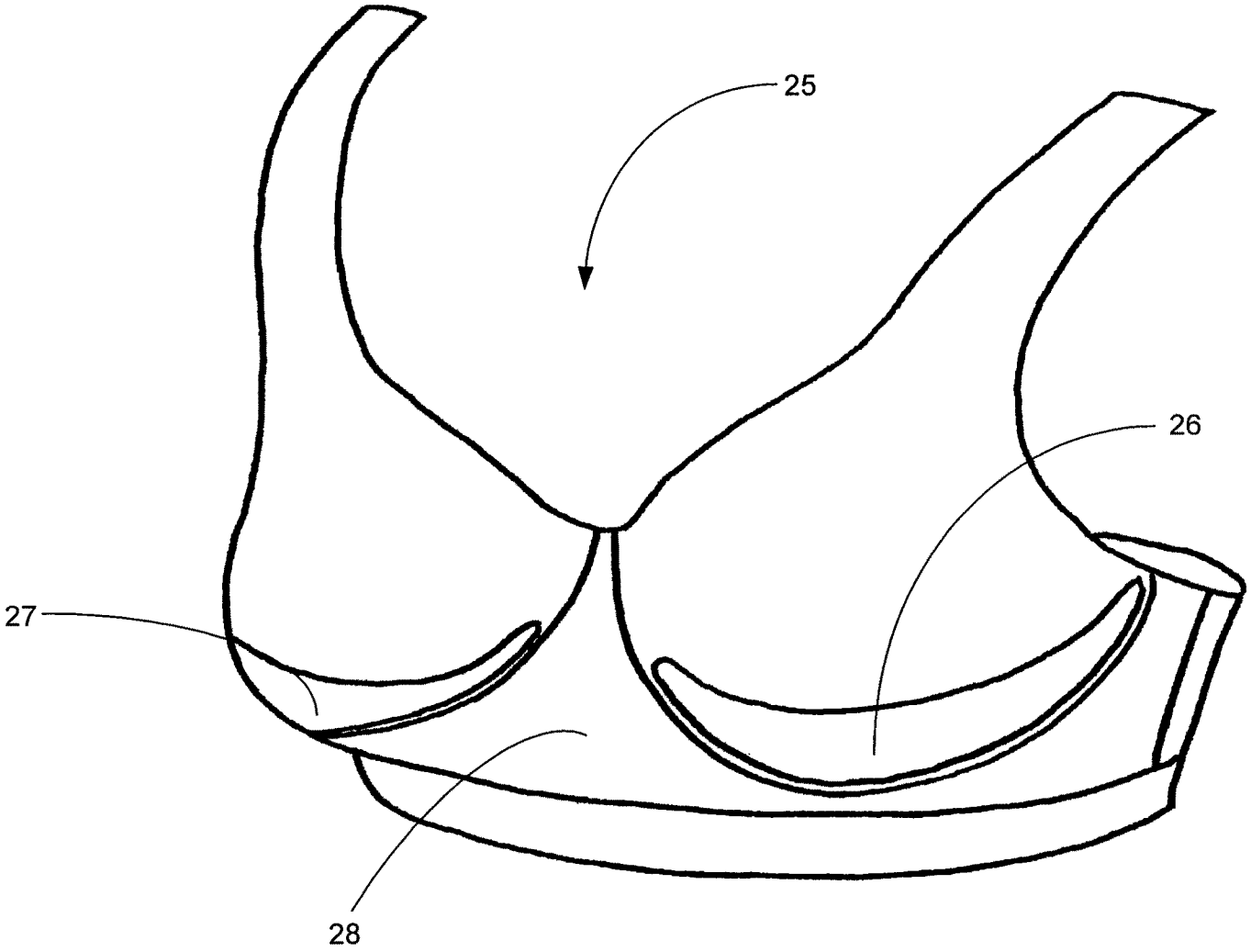
FIG. 11 shows a bra including a partial cup according to another embodiment.

FIG. 11 shows a further partial cup embodiment in which the partial cups 26 and 27 of bra 25 do not include wings.

There is thus provided sports motion and/or impact control bras that provide improved comfort, mobility and protection whilst maintaining desirable aesthetics and usability. By imposing a desired shape on the breast and providing appropriate support improved motion control can be achieved and harmonic motion inhibited (unconstrained breasts naturally move in a figure of 8 pattern during exercise). By maintaining the center of gravity of the breasts closer to the body rotational forces on the breasts may be reduced. The design provides impact protection without unduly inhibiting motion and comfort. By providing effective anchoring of the cups and shaping of the breasts the shoulder load may be reduced. The bras may be easily and cost effectively be constructed as integrated articles and are easy to use as they require no separate inserts.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. A sports bra including:

a. a fabric bra body;

b. a pair of molded partial cups incorporated into the bra body and positioned so as to, in use, support a user's breasts, each cup including:

i. a molded main breast engaging section having:

a. a top edge, b. a bottom edge, c. an inside edge, wherein the inside edges of the cups face each other; and d. an outside edge;

wherein each cup has a generally concave form from each of the top edge, the bottom edge, the inside edge, and the outside edge to a center of the cup; and ii. an inflexion region provided at the bottom edge of each cup having a reverse curve, opposite to the concave form of each cup, configured to provide support for each partial cup from a user's chest; and c. at least one side strap which connects to respective cups so as to, in use, anchor the outside edges of the cups to a user's torso.

2. The bra as claimed in claim 1 wherein each molded cup is configured to provide uplift such that overlap of the breast with the torso is avoided.

3. The bra as claimed in claim 1 wherein each cup reduces in thickness towards one or more of the top edge, the bottom edge, the inside edge, and the outside edge of each cup.

4. The bra as claimed in claim 1 wherein each cup is of composite construction.

5. A sports bra including:

a. a fabric bra body;

b. a pair of molded partial cups of composite construction incorporated into the bra body and positioned so as to, in use, support a user's breasts, each cup including:

i. a molded main breast engaging section having:

a. a top edge, b. a bottom edge, c. an inside edge, wherein the inside edges of the cups face each other; and d. an outside edge; and ii. a molded non-breast engaging extension integrally formed with the main breast engaging section and configured to extend from the outside edge of the molded main breast engaging section to an area under an arm of a user; and c. at least one side strap which connects to respective extensions so as to, in use, anchor the outside edges of the cups to a user's torso.

6. The bra as claimed in claim 5 wherein the bottom edge of each cup has an inflexion region at the bottom edge of each cup configured to provide support for each partial cup from a user's chest.

7. The bra as claimed in claim 5 wherein each molded cup is configured to provide uplift such that overlap of the breast with the torso is avoided.

8. The bra as claimed in claim 5 wherein the cups have foam cushioning on interior faces of the cups.

9. The bra as claimed in claim 8 wherein the foam is shape memory foam.

10. The bra as claimed in claim 5 wherein each cup reduces in thickness towards one or more of the top edge, the bottom edge, the inside edge, and the outside edge of each cup.

11. A sports bra including:

a. a fabric bra body;

b. a pair of molded partial cups incorporated into the bra body and positioned so as to, in use, support a user's breasts, each cup including:

i. a molded main breast engaging section having:

1. a top edge,
2. a bottom edge,
3. an inside edge, wherein the inside edges of the cups face each other; and
4. an outside edge;

ii. wherein each cup decreases in thickness towards one or more of the top edge, the bottom edge, the inside edge, and the outside edge of each cup; and iii. the bottom edge of each cup has an inflexion region at the bottom edge of each cup configured to provide support for each partial cup from a user's chest; and c. at least one side strap which connects to respective outside edges of the cups.

12. The bra as claimed in claim 11 wherein each molded cup is configured to provide uplift such that overlap of the breast with a user's torso is avoided.

13. The bra as claimed in claim 11 wherein the cups have foam cushioning on interior faces of the cups.

14. The bra as claimed in claim 13 wherein the foam is shape memory foam.

15. The bra as claimed in claim 11 wherein the left and right cups of the bra are shaped for the left and right breasts of a user.

16. The bra as claimed in claim 11 wherein each cup is of composite construction.

* * * * *